US012642354B2

(12) United States Patent
Zeberg

(10) Patent No.: US 12,642,354 B2
(45) Date of Patent: Jun. 2, 2026

(54) RAIL MOUNTING SYSTEM FOR FURNITURE

(71) Applicant: Inter IKEA Systems B.V., Delft (NL)

(72) Inventor: David Zeberg, Kyrkhult (SE)

(73) Assignee: Inter IKEA Systems B.V. (NL)

( * ) Notice: Subject to any disclaimer, the term of this patent is extended or adjusted under 35 U.S.C. 154(b) by 0 days.

(21) Appl. No.: 18/847,681

(22) PCT Filed: Mar. 13, 2023

(86) PCT No.: PCT/SE2023/050224

§ 371 (c)(1),
(2) Date: Sep. 16, 2024

(87) PCT Pub. No.: WO2023/177343

PCT Pub. Date: Sep. 21, 2023

(65) Prior Publication Data

US 2025/0194800 A1 Jun. 19, 2025

(30) Foreign Application Priority Data

Mar. 17, 2022 (SE) ..... 2250336-1

(51) Int. Cl.
*A47B 96/06* (2006.01)
*A47B 95/00* (2006.01)

(52) U.S. Cl.
CPC ..... *A47B 96/067* (2013.01); *A47B 95/008* (2013.01)

(58) Field of Classification Search
CPC .. A47B 96/067; A47B 95/008; F16M 13/022; A47F 5/0846; A47F 5/0838; A61G 12/005; A61G 13/101; A61B 90/57; A61B 90/571
See application file for complete search history.

(56) References Cited

U.S. PATENT DOCUMENTS 3,003,600 A 10/1961 Mackenzie
4,457,436 A * 7/1984 Kelley ..... A47B 95/008 312/246

(Continued)

FOREIGN PATENT DOCUMENTS

CH 695820 A5 9/2006
DE 102010027178 A1 1/2012

(Continued)

OTHER PUBLICATIONS

Extended EP Search Report, EP23771174.2, dated Feb. 13, 2025.

*Primary Examiner* — Ko H Chan
(74) *Attorney, Agent, or Firm* — Fishman Stewart PLLC

(57) ABSTRACT

An extendable wall rail system may include a first rail member, a second rail member, and a joining member. The first and second rail members may each have a rail member first surface configured for attachment to a wall, a first retaining arrangement portion, and a second retaining arrangement portion. The joining member may include first engagement portions and second engagement portions. The joining member may be configured to releasably join the first rail member to the second rail member via matingly engaging i) the first retaining arrangement portions of the first rail member and the second rail member with the first engagement portions and ii) the second retaining arrangement portions of the first rail member and the second rail member with the second engagement portions, to form a rotationally rigid joint between the first and second rail members.

20 Claims, 10 Drawing Sheets

(56) References Cited

U.S. PATENT DOCUMENTS

| | | | | |
|---|---|---|---|---|
| 4,516,874 | A | 5/1985 | Yang | |
| 4,996,801 | A * | 3/1991 | Ristow | E04D 13/1415 52/273 |
| 7,014,052 | B2 * | 3/2006 | Dettorre | A47F 5/0838 211/94.01 |
| 9,209,609 | B2 * | 12/2015 | Kellerman | E04B 1/5812 |
| 10,271,652 | B2 * | 4/2019 | Kilburn | E05D 15/0604 |
| 10,646,035 | B1 * | 5/2020 | Schindehette | A47B 47/028 |
| D914,418 | S * | 3/2021 | Kilburn | D6/702 |
| 2010/0086348 | A1 | 4/2010 | Funahashi | |
| 2011/0309731 | A1 | 12/2011 | Lindvall | |
| 2012/0181240 | A1 | 7/2012 | Crowley | |
| 2012/0291261 | A1 | 11/2012 | Davis | |
| 2016/0348371 | A1 | 12/2016 | Stulier | |
| 2018/0042378 | A1 | 2/2018 | Kilburn | |
| 2022/0257014 | A1 * | 8/2022 | Tooley | A47B 95/008 |

FOREIGN PATENT DOCUMENTS

| | | | |
|---|---|---|---|
| EP | 3051977 | A1 | 8/2016 |
| EP | 3132899 | A1 | 2/2017 |
| WO | 2012034673 | A1 | 3/2012 |

* cited by examiner

RAIL MOUNTING SYSTEM FOR FURNITURE

CROSS-REFERENCE TO RELATED APPLICATIONS

This application claims priority to International Patent Application No. PCT/SE2023/050224, filed on Mar. 13, 2023, and Swedish Patent Application No. SE 2250336-1, filed on Mar. 17, 2022, the contents of both of which are hereby incorporated by reference in their entirety.

TECHNICAL FIELD

The present invention relates to wall mounting systems and more precisely to an extendable wall rail system.

BACKGROUND

The attachment of items to walls is something everyone has been faced with and the challenges that may arise from this are commonly known. Simple tasks such as hanging a painting may pose challenges depending on the size of the painting and the construction of the wall. It is generally sufficient to attach a painting at one point to a wall. As paintings tend to be fairly light weights, it may generally be hung anywhere on a wall without consideration of beams etc.

When attaching more sturdy constructions to a wall where the constructions have to carry a significant load, such as kitchen cabinets, wall mounted shelves etc., great care has to be taken when attaching these constructions to the wall. It is common that such constructions require attachments to beams of the wall rather than only attachment to gypsum or dry-wall material of the wall.

In order to ensure that the constructions are supported by beams of the walls, it is common to fasten a rail horizontally to the wall and hang a load, be it kitchen cabinets or shelves, from this horizontal rail. The rail extends between a plurality of beams of the wall to ensure that the load is divided between more than one beam.

In EP3051977 A1, a mounting system is presented wherein a longitudinal rail is horizontally attached to a wall by multiple wall supports. The wall supports may be arranged at beams of the wall but the length of the rail has to extend the full length of the construction which means that it will either extend beyond the construction, have to be cut to length or customized already at manufacturing.

It is apparent that the prior art will cause installation problems making it difficult to present a modular solution that may be adapted to any horizontal length of the construction without having to cut the, often metal, beams or rails attached to the wall.

SUMMARY

It is in view of the above considerations and others that the various embodiments of this disclosure have been made. The present disclosure therefor recognizes the fact that there is a need for improvement of the existing art described above.

An object of the present disclosure is to provide a new type of wall rail system which is improved over prior art and which eliminates or at least mitigates the drawbacks discussed above. More specifically, an object of the invention is to provide an extendable wall rail system that is may be extended to a desired length allowing easy installation and comparable freedom in placement. These objects are achieved by the technique set forth in the appended independent claims with preferred embodiments defined in the dependent claims related thereto.

In a first aspect, an extendable wall rail system is presented. The system comprises a first rail member and a second rail member, each having a rail member first surface configured for attachment to a wall, a first retaining arrangement portion and a second retaining arrangement portion. The system further comprises a joining member configured to releasably join the first rail member to the second rail member by matingly engaging the first retaining arrangement portions of the first rail member and the second rail member with first engagement portions of the joining member and the second retaining arrangement portion of the first rail member and the second rail member with second engagement portions of the joining member, to form a rotationally rigid joint between the first rail member and the second rail member.

In one variant, the first retaining arrangement portions are provided at a first longitudinal edge of the rail members and/or the second retaining arrangement portions are provided at a second longitudinal edge of the rail members. This is beneficial as the design is simplified decreasing production cost and material cost.

In one variant, the first retaining arrangement portion and/or the second retaining arrangement portion is a guide track provided with a retaining surface having a normal extending towards a plane of the rail member first surface and the joining member is provided with a corresponding engagement portion configured to be arranged between the retaining surface and the plane of the rail member first surface to matingly engage the guide track.

In one variant, the guide track extends along a full longitudinal length of the associated rail member. This is beneficial as it simplifies production and increases the stability and durability of the guide track.

In one variant, the first engagement portion and/or the second engagement portion comprises a guide track provided with a retaining surface configured to, when in engagement with the first rail member and/or the second rail member, have a normal extending away from a plane of the rail member first surface and the first retaining arrangement portion and/or the second retaining arrangement portion is a corresponding engagement portion configured to matingly engage the guide track such that the retaining surface is arranged between the engagement portion and the plane of the first surface.

In one variant, the extendable wall rail system further comprises a furniture bracket for attachment to the piece of furniture. The furniture bracket is configured to releasably engage the first rail member and/or the second rail member. This is beneficial as the furniture brackets may be used with any furniture and the releasable configuration allows for easy attachment of the furniture bracket (and thereby the piece of furniture) to the wall rail system.

In one variant, the furniture bracket is configured to be attached to a side of the piece of furniture. This is beneficial as the sides of the furniture are generally better suited to carry heavy loads.

In one variant, each rail member is provided with a mounting bracket configured to attach a piece of furniture to the extendable wall rail system. The mounting bracket extends from a rail member second surface of each rail member, wherein the rail member second surface being opposite the rail member first surface.

In one variant, each rail member is provided with two mounting brackets, one arranged at each longitudinal edge of the rail member.

In one variant, the first rail member and/or the second rail member is provided with a plurality of through holes spaced along a longitudinal extension of the rail member for attachment of the rail member to the wall.

In one variant, the first rail member and/or the second rail member further comprises an enlarged through hole having a diameter that is greater than a diameter of the through holes. The extendable wall rail system further comprises a washer configured to be movable along the first retaining arrangement portion and the second retaining arrangement portion of the rail member. The washer is provided with a longitudinal through hole, i.e. a longitudinally shaped hole, having, when engaging the retaining arrangement portions, its longitudinal extension arranged at an angle to the longitudinal extension of the rail members.

In one variant, the longitudinal extension of the longitudinal through hole of the washer is arranged at an angle of 25 to 65° to the longitudinal extension of the rail members.

In one variant, the longitudinal extension of the longitudinal through hole of the washer is arranged at an angle of 45° to the longitudinal extension of the rail members.

In one variant, the joining member is provided with a plurality of through holes configured to coincide with corresponding through holes of the first and second rail members when the joining member is arranged to extend the first rail member with the second rail member.

In one variant, the rail member or joining member engaging the guide track is provided with a beveled corner for insertion into the guide track. This is beneficial as it simplifies the joining if the joining member to the rail members.

In one variant, the joining member is provided with a stop element configured to control a maximum distance the joining member is inserted into each guide track.

In a second aspect, a furniture bracket for attachment to a piece of furniture is presented. The furniture bracket is configured to releasably engage an extended wall rail system of any one the first aspect.

In a third aspect, a wall mounted piece of furniture is presented. The wall mounted piece of furniture comprises a first rail member configured to form part of the extendable wall rail system of the first aspect, a furniture bracket for attachment to the piece of furniture, wherein the furniture bracket is configured to releasably engage the first rail member. The piece of furniture is formed with a width being equal to or longer than a longitudinal extension of the first rail member.

In one variant, the piece of furniture is a cupboard or a cabinet.

In a fourth aspect, a furniture system is presented. The furniture system comprises two or more wall mounted pieces of furniture of the third aspect and a joining member configured to form part of the extendable wall rail system of the first aspect.

BRIEF DESCRIPTION OF THE DRAWINGS

Embodiments of the invention will be described in the following; references being made to the appended diagrammatical drawings which illustrate non-limiting examples of how the inventive concept can be reduced into practice.

DETAILED DESCRIPTION OF EMBODIMENTS

Figure 1:
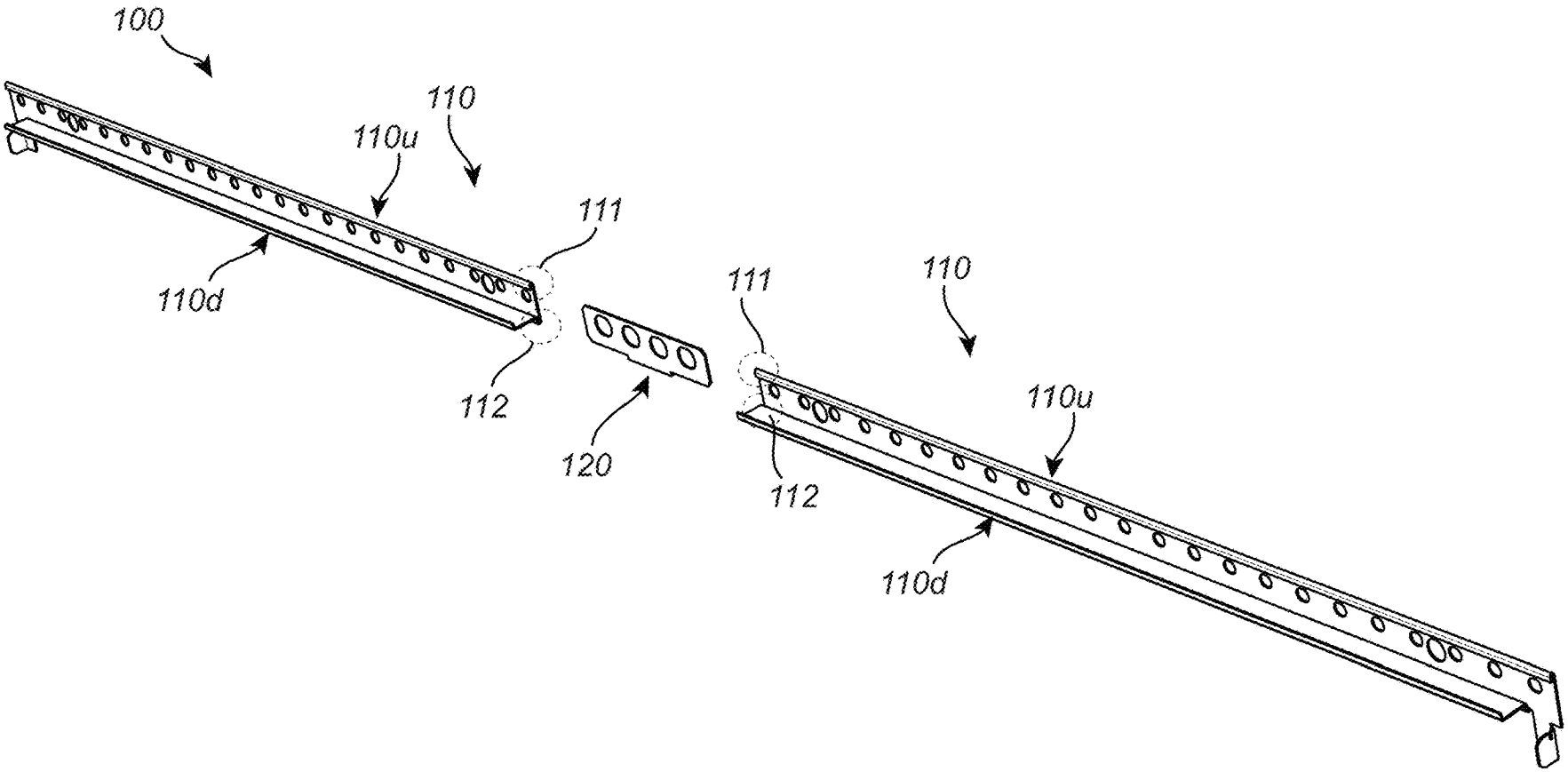
FIG. 1 is a perspective view of an extendable wall rail system according to embodiments of the present disclosure.

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

The term "coupled" is defined as connected, although not necessarily directly, and not necessarily mechanically. Two or more items that are "coupled" may be integral with each other. The terms "a" and "an" are defined as one or more unless this disclosure explicitly requires otherwise. The terms "substantially," "approximately," and "about" are defined as largely, but not necessarily wholly what is specified, as understood by a person of ordinary skill in the art. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method that "comprises," "has," "includes" or "contains" one or more steps possesses those one or more steps, but is not limited to possessing only those one or more steps.

The present disclosure relates an extendable wall rail system and the configuration of the extension of this extendable wall rail system. The extendable wall rail system is configured for being mounting substantially horizontally to a wall. Generally, any rotation or movement described herein is with reference to a plane of the wall to which the extendable wall rail system is mounted, or intended to be mounted to.

As an introductory example, assume that four kitchen cabinets is to be installed on a wall having a center-to-center (cc) distance between beams of 600 mm. The kitchen cabinets are 600 mm wide and are indirectly attached to the wall via a horizontal rail, where the horizontal rail is directly attached to the wall. The cabinets will carry plates and glass and will consequently require the support of at least three beams of the wall. In order to accomplish this, the horizontal rail has to be at least 2400 mm to support all four cabinets. A 2400 mm rail is difficult to handle and cumbersome to transport. If fewer or more cabinets are installed, specific lengths of the horizontal rail has to be provided or, a longer rail has to be cut to length making installation more difficult.

Alternatively, systems may be provided where each cabinet is provided with an individual horizontal rail with a length configured for the width of the cabinet. This removes the requirement of having to cut the horizontal rail to length and further provides an opportunity to mount the cabinet with the horizontal rail hidden inside the cabinet thereby allowing a flush installation to the wall without a need for cutouts at a back of the cabinet. However, as each cabinet is likely to require the support of two wall beams, such installations have to be aligned with the beams of the wall, thereby reducing the freedom of placement along the wall when installing the cabinet.

The inventors behind the present disclosure have invented an extendable wall rail system 100, 200 that addresses the problems of the prior at. One embodiment of extendable wall rail system 100, 200 is illustrated in FIG. 1 and another in FIG. 4. Common for these embodiments is that the extendable wall rail system 100, 200 comprises a first rail member 110, 210 and a second rail member 110, 210. The rail members 110, 210 may be of the same length and/or configuration or, as will be understood by the skilled person after contemplating the teachings herein, of different lengths and/or different configurations.

Figure 2A:
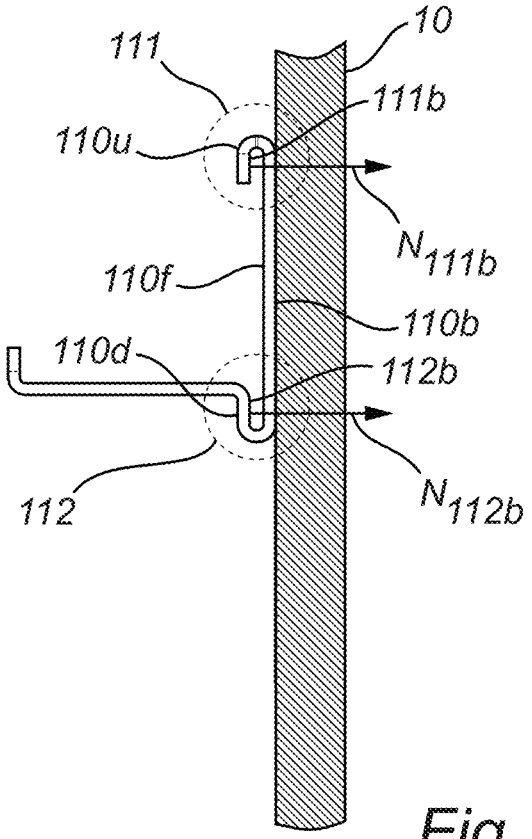
FIGS. 2*a* and 2*b* are views of a rail member according to embodiments of the present disclosure.
Figure 5A:
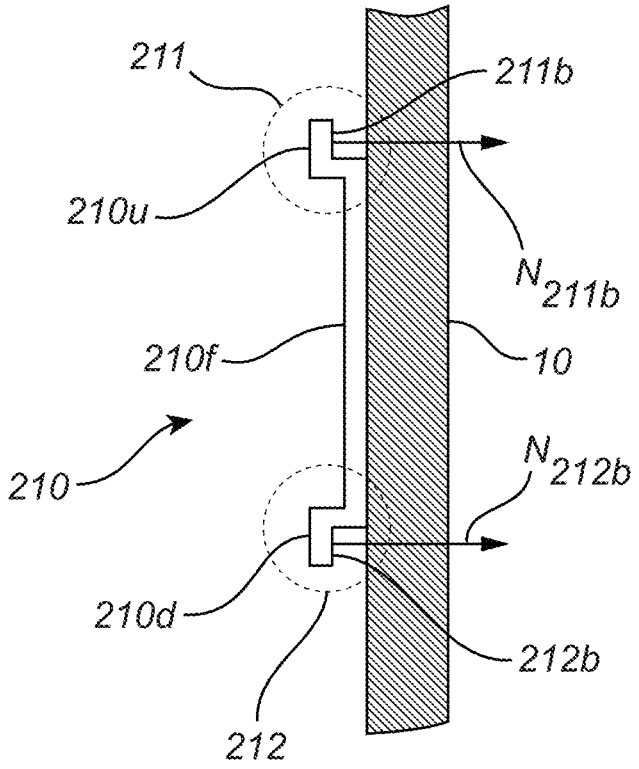
FIGS. 5*a* and 5*b* are views of a rail member according to embodiments of the present disclosure.

Each of the rail members 110, 210 comprises a rail member first surface 110*b*, 210*b* (see FIGS. 2*a* and 5*a*), i.e. a back surface, or simply back, configured for substantially flush attachment to a wall 10 (see FIGS. 2*a* and 5*a*). The first rail member 110, 210 may be extended with the second rail member 110, 210 by providing a joining member 120, 220 of the extendable wall rail system 100, 200 longitudinally between the first rail member 110, 210 and the second rail member 110, 210. The joining member 120, 220 will matingly engage the first rail member 110, 210 and the second rail member 110, 220 to form a rotationally rigid joint between the rail members 110, 210. This means that forces subjected to the first rail member 110, 210 will be distributed also to the second rail member 110, 210 by the joining member 120, 220. In practice, the first rail member 110, 210 may be attached to only one beam of a wall 10 and the second rail 110, 210 may also be attached to only one beam of the wall 10 but, when joined by the joining member, the extended wall rail system 100 will effectively be attached to the wall 10 at two beams. Due to the rotationally rigid joint provided between the first rail member 110, 120 and the second rail member 110, 120 by the joining member 120, 220, the first and second rail members 110, 120 will, when joined, exhibit substantially the same rotational rigidity as one single rail having a longitudinal length corresponding to combined longitudinal lengths of the first rail member 110, 120 and the second rail member 110, 120.

In order to provide this rotationally rigid joint between the first rail 110, 210 and the second rail member 110, 210, each of the rail members 110, 210 is provided with a first retaining arrangement portion 111, 211 and a second retaining arrangement portion 112, 212. The joining member 120, 220 is configured to engage the retaining arrangement portions 111, 112, 211, 212 of the rail members 110, 210 to provide the rotationally rigid joint. As each rail member 110, 210 comprises at least two retaining arrangement portions 111, 112, 211, 212, a rotationally rigid joint may be formed. For each rail member 110, 210 the first retaining arrangement portion 111, 211 is preferably separated from the second retaining arrangement portion 112, 212 in a direction perpendicular to the longitudinal extension of the rail member 110, 210 and along, or parallel to the rail member first surface 110*b*, 210*b*. This means that the rotational rigidity is highest in a plane (or in a parallel plane) of the rail member first surface 110*b*. It may, in some embodiments, be sufficient to only fasten e.g. the first rail member 110, 210 to two beams of the wall 10 and have the second rail member 110, 210 only fastened to the wall 10 via the first rail member 110 when configured to join (extend) the first rail member 110, 210 by the joining member 120, 220. This will, as the skilled person will understand, depend on the rigidity of each of the rail members 110 and how high load the extendable wall rail system 100, 200 is intended to carry.

Turning to FIG. 2*a*, a cross-sectional side view of one embodiment of a rail member 110 is shown. The rail member first surface 110*b* is arranged to a wall 10, i.e. adjacent to and in contact with the wall 10, preferably flush with the wall. A rail member second surface 110*f* is opposite the rail member first surface 110*b*. The rail member first surface 110*b* may extend along an entire longitudinal length of the rail member 110 or be shorter than the longitudinal length of the rail member 110. It should be mentioned that, when it is stated that the rail member first surface 110*b* is arranged, or configured to be arranged, in (flush) attachment to the wall 10, this is to be interpreted as substantially flush to the wall 10 as not all walls are perfectly flat (but this is readily understood by the skilled person). The first retaining arrangement portion 111 is in this embodiment formed as a first guide track 111 and the second retaining arrangement portion 112 is in this embodiment formed as a second guide track 112. The first retaining arrangement portion 111 is arranged at a first longitudinal edge 110*u* of the rail member 110. The first guide track 111 forming the first retaining arrangement portion 111 is provided by folding the first longitudinal edge 110*u* away from the rail member first surface 110*b* to form the first guide track 111 such that a guide track first surface 111*b* of the first guide track 111 is arranged with its normal $N_{111b}$ directed into (towards) a plane $P_{110b}$ (see FIG. 2*b*) of the rail member first surface 110*b*. Similarly, the second retaining arrangement portion 112 is arranged at a second longitudinal edge 110*b* of the rail member 110. The second guide track 112 forming the second retaining arrangement portion 112 is provided by folding the second longitudinal edge 110*b* away from the rail member first surface 110*b* to form the second guide track 112 such that a guide track first surface 112*b* of the second guide track 112 is arranged with its normal $N_{112b}$ directed into (towards) the plane $P_{110b}$ of the rail member first surface 110.

Figure 2B:
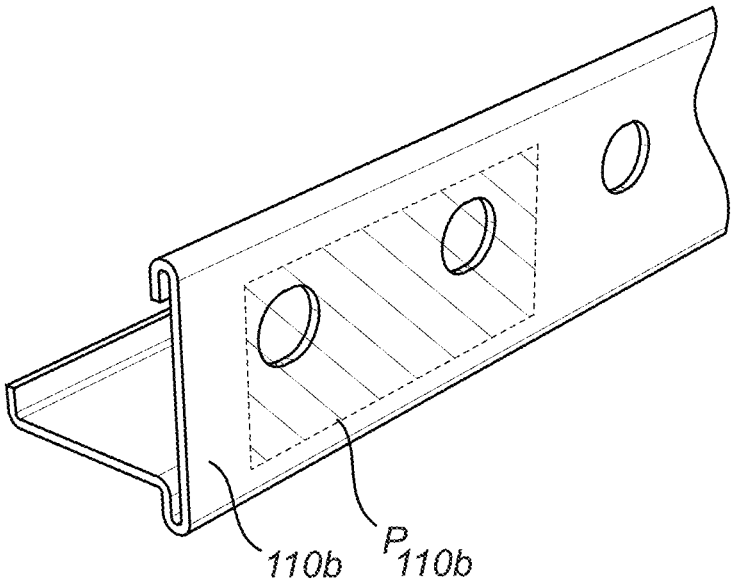

In FIG. 2*b*, the same embodiment of the rail member 110 as illustrated in FIG. 2*a* is shown, but in a perspective view. In this view, the plane $P_{110b}$ of the rail member first surface 110*b* is visible. The guide track first surface 111*b* of the first retaining arrangement portion 111 and the guide track first surface 112*b* of the second retaining arrangement portion 112 are, as previously specified, directed with their respective normal $N_{111b}$, $N_{112b}$ directed into the plane $P_{110b}$ of the rail member first surface 110*b*. It should be mentioned that, the guide track first surfaces 111*b*, 112*b* of the retaining arrangements 111, 112 may be parallel to the plane $P_{110b}$ of the rail member first surface 110*b* such that the normal $N_{111b}$, $N_{112b}$ of the guide track first surfaces 111*b*, 112*b* are intersecting the plane $P_{110b}$ perpendicularly. In some embodiments, the guide track first surfaces 111*b*, 112*b* of the retaining arrangements 111, 112 are not parallel to the plane $P_{110b}$ of the rail member first surface 110*b* such that the normal $N_{111b}$, $N_{112b}$ of the guide track first surfaces 111*b*, 112*b* are intersecting the plane $P_{110b}$ at an angle different from 90°.

In the embodiment described with reference to FIGS. 2*a* and 2*b*, the first and second guide tracks 111, 112 are formed at the respective longitudinal edges 110*u*, 110*d* of the rail member 110. This is beneficial as the guide tracks 111, 112 are cost effective and comparably simple to form by folding the respective longitudinal edges 110*u*, 110*d* back on itself. However, the first and second guide tracks 111, 112 may very well be formed, with similar shape, at any position between the first and second longitudinal edges 110*u*, 110*d*. This may be accomplished by creasing the rail member 110 and folding the crease back on itself, or by simply adding, e.g. by welding, material to form the guide tracks 111, 112.

Figure 3:
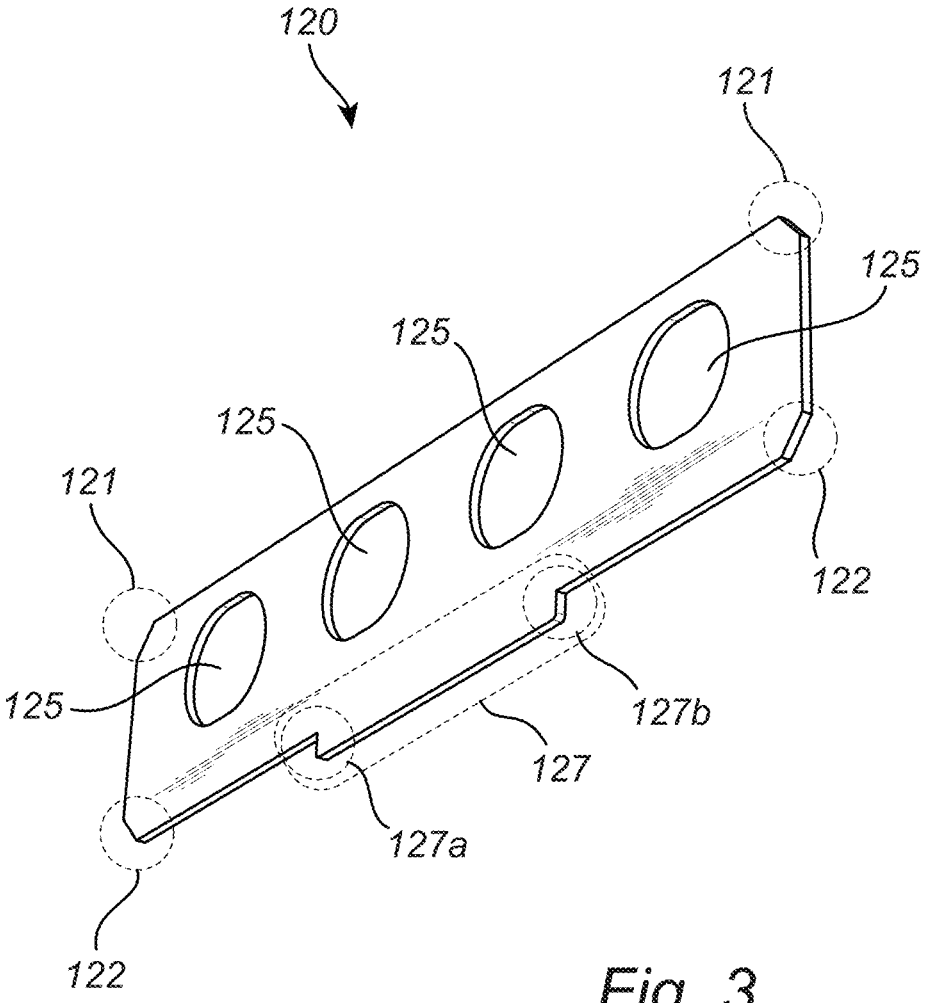
FIG. 3 is a perspective view of a joining member according to embodiments of the present disclosure.

In FIG. 3, a joining arrangement 120 compatible with, and forming part of, the extendable wall rail system 100 of FIGS. 2*a-b* is shown. The joining arrangement 120 is configured to releasably and rotationally rigidly join the first rail member 110 to the second rail member 110. To this end, the joining arrangement 120 is provided with first engagement portions 121 adapted to engage the first retaining arrangement portions 111 of the first rail members 110. The joining arrangement 120 is further provided with second engagement portions 122 adapted to engage the second retaining arrangement portions 112 of the first rail members 110. When the retaining arrangement portions 111 are guide tracks 111 as shown in FIGS. 2*a-b*, the engagement portions 121, 122 may be planar engagement portions 121, 122 configured to be sandwiched between the guide track first surfaces 111*b*, 112*b* and the guide rail first surface 110*b*. When the joining arrangement 120 is engaging the guide track 110, the normal $N_{111b}$, $N_{112b}$ from the guide track first surfaces 111*b*, 112*b* will intersect the engagement portions 121, 122 before intersecting the plane $P_{110b}$ of the rail member first surface 110*b*. The joining arrangement 120 is preferably mirrored about longitudinally center, such that one first engagement portion 121 and one second engagement portion 122 is provided at each longitudinal end of the joining arrangement 120.

Figure 4:
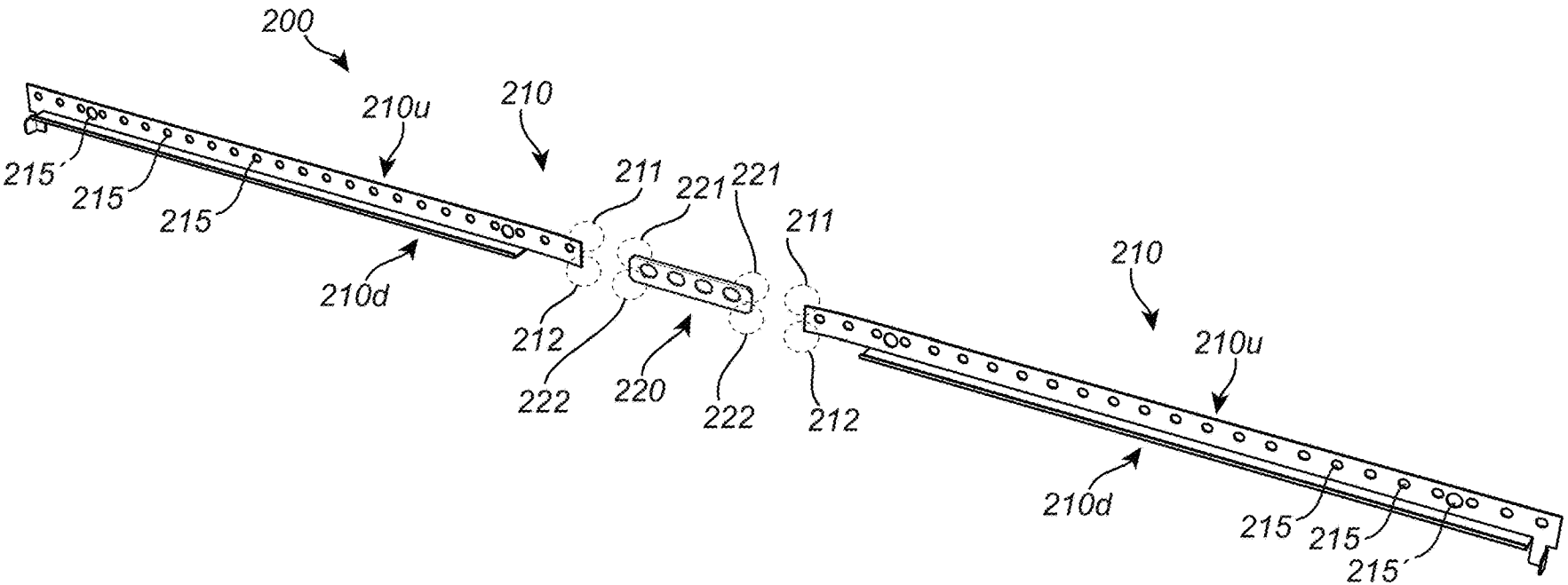
FIG. 4 is a perspective view of an extendable wall rail system according to embodiments of the present disclosure.

With reference to FIG. 4, an alternative embodiment of the extendable wall rail system 200 will be explained. In the embodiment of FIG. 4 functions substantially in the same way as the embodiment of FIG. 1 but with reversed arrangement of the geode tracks the planar engagement portions. In the previous embodiment, the guide tracks 111, 112 were provided on the rail members 110 and mating planar engagement portions 121, 122 were provided on the joining arrangement 120. In the embodiment of FIG. 4, the guide tracks 211, 212 are provided on the joining member 220, and mating planar engagement portions 211, 212 were provided on the rail members 210. This will be explained in more detailed in the following, starting with FIG. 5*a*.

In FIG. 5*a*, a cross-sectional side view of the second embodiment of the rail member 210 is shown. The rail member first surface 210*b* is, as in the previous embodiment, arranged to the wall 10, i.e. adjacent to and in contact with the wall 10, preferably flush with the wall 10. The rail member first surface 210*b* may extend along an entire longitudinal length of the rail member 210 or be shorter than the longitudinal length of the rail member 210. A rail member second surface 210*f* is opposite the rail member first surface 210*b*. It should be mentioned that, when it is stated that the rail member first surface 210*b* is arranged, or configured to be arranged, in (flush) attachment to the wall 10, this is to be interpreted as substantially flush to the wall 10 as not all walls are perfectly flat but this is readily understood by the skilled person. The first retaining arrangement portion 211 and the second retaining arrangement portion 212 are, is in this embodiment, formed as planar engagement portions 211, 212. The first retaining arrangement portion 211 is arranged at a first longitudinal edge 210*u* of the rail member 210. The planar engagement portion 211 forming the first retaining arrangement portion 211 may be provided by forming a crease (e.g. folding) at first longitudinal edge 210*u* away from the rail member first surface 210*b* and, at a position between the crease and the first longitudinal edge 210*u* folding the first longitudinal edge 210*u* towards the rail member first surface 210*b*, creating a step at the first longitudinal edge 210*u* of the rail member 210. The first planar engagement portion 211 is preferably arranged such that an engagement portion first surface 211*b* of the first planar engagement portion 211 is provided having its normal $N_{211b}$ directed into the plane $P_{210b}$ (see FIG. 5*b*) of the rail member first surface 210*b*. Similarly, the second retaining arrangement portion 212 is arranged at a second longitudinal edge 210*d* of the rail member 210. The planar engagement portion 212 forming the second retaining arrangement portion 212 may be provided by forming a crease (e.g. folding) by the second longitudinal edge 210*d* away from the rail member first surface 210*b* and, at a position between the crease and the second longitudinal edge 210*d* folding the second longitudinal edge 210*d* towards the rail member first surface 210*b*, creating a step at the second longitudinal edge 210*d* of the rail member 210. The second planar engagement portion 212 is arranged such that an engagement portion first surface 212*b* the of second planar engagement portion 212 is provided having its normal $N_{212b}$ directed into the plane $P_{210b}$ of the rail member first surface 210*b*.

Figure 5B:
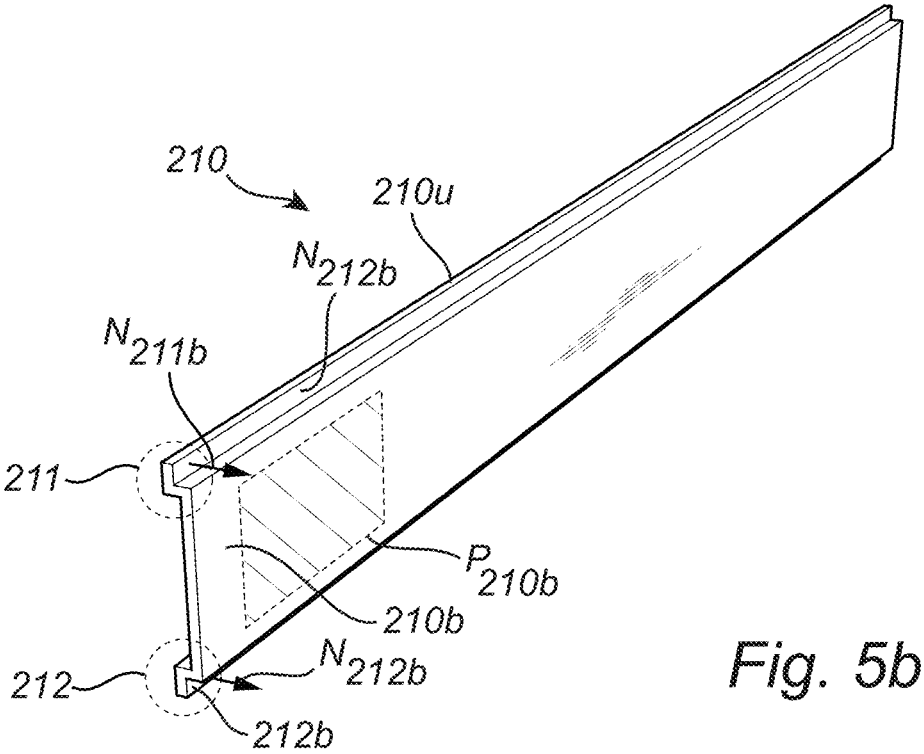

In FIG. 5*b*, the same embodiment of the rail member 210 as illustrated in FIG. 5*a* is shown but in a perspective view. In this view, the plane $P_{210b}$ of the guide track first surface 210*b* is visible. The engagement portion first surface 211*b* of the first retaining arrangement portion 211 and the engagement portion first surface 212*b* of the second retaining arrangement portion 212, are, as previously specified, directed with their respective normal $N_{211b}$, $N_{212b}$ directed into the plane $P_{210b}$ of the guide track first surface 210*b*. It should be mentioned that, the engagement portion first surfaces 211*b*, 212*b* of the retaining arrangements 211, 212 may be parallel to the plane $P_{110b}$ of the engagement portion first surface 110*b* such that the normal $N_{211b}$, $N_{212b}$ of the guide track first surfaces 211*b*, 212*b* are intersecting the plane $P_{210b}$ perpendicularly. In some embodiments, the engagement portion first surfaces 211*b*, 212*b* of the retaining arrangements 211, 212 are not parallel to the plane $P_{210b}$ of the rail member first surface 210*b* such that the normal $N_{211b}$, $N_{212b}$ of the guide track first surfaces 211*b*, 212*b* are intersecting the plane $P_{210b}$ at an angle different from 90°.

As with the previous embodiment, in the embodiment described with reference to FIGS. 5*a* and 5*b*, the first and second engagement portions 211, 212 are formed at the respective longitudinal edges 210*u*, 210*d* of the rail member 210. This is beneficial as the engagement portions 211, 212 are cost effective and comparably simple to form by folding, or creasing, the respective longitudinal edges 210*u*, 210*d*. However, the first and second engagement portions 211, 212 may very well be formed, with similar shape, at any position between the first and second longitudinal edges 210*u*, 210*d*. This may be accomplished by creasing the rail member 210 and folding the crease towards the respective longitudinal edges 210*u*, 210*d*, or by simply adding, e.g. by welding, material to form the engagement portions 211, 212.

Figure 6:
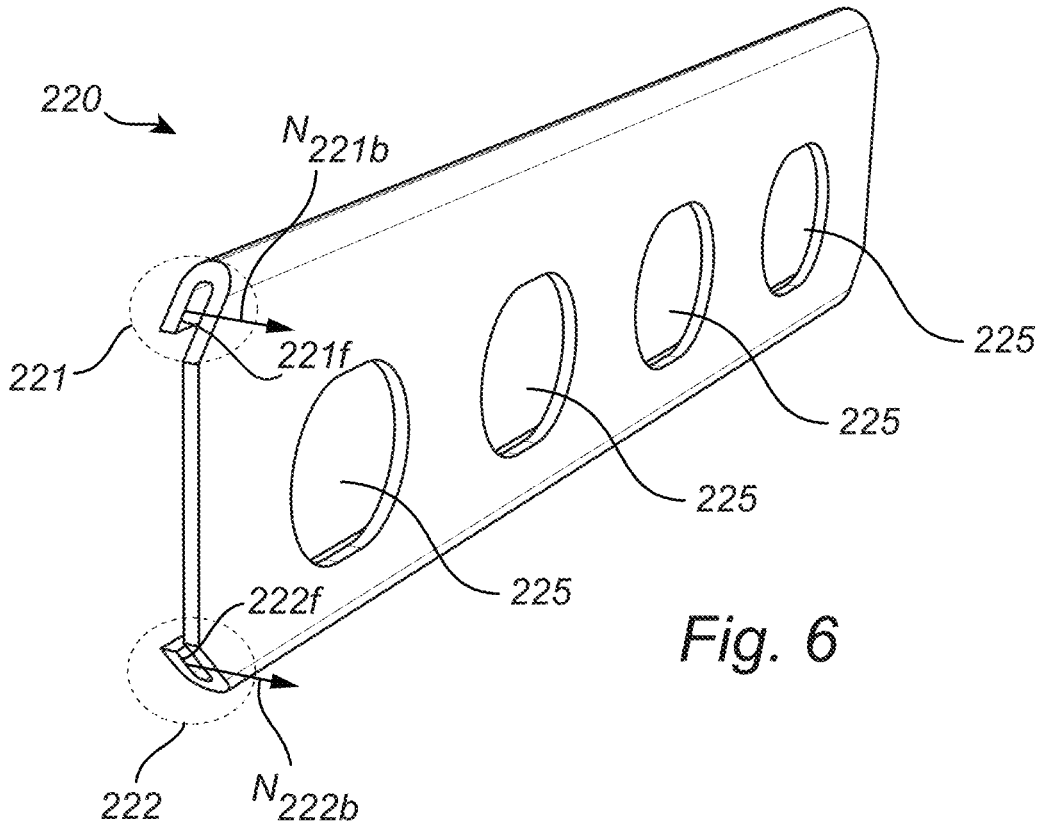
FIG. 6 is a perspective view of a joining member according to embodiments of the present disclosure.

In FIG. 6, a joining arrangement 220 compatible with, and forming part of, the extendable wall rail system 200 of FIGS. 5*a-b* is shown. The joining arrangement 220 is configured to releasably and rotationally rigidly join the first rail member 210 to the second rail member 210. To this end, the joining arrangement 220 is provided with first engagement portions 221 adapted to engage the first retaining arrangement portions 211 of the first rail members 210. The joining arrangement 220 is further provided with second engagement portions 222 adapted to engage the second retaining arrangement portions 212 of the first rail members 210. When the retaining arrangement portions 211, 212 are planar engagement portions 211, 212 as shown in FIGS. 5*a-b*, the engagement portions 221, 222 may be guide tracks 221, 222 similar to the guide tracks 111, 112 of the rail member 110 described with reference to FIGS. 1-3. The guide tracks 221, 222 are configured to sandwich the engagement portions 211, 212 of the rail member descried with reference to FIGS. 5*a-b*. A first guide track 221 of the joining arrangement 220 is provided with a retaining surface 221*f* configured to, when in engagement with the rail member 210, have a normal $N_{221f}$ extending away from the plane $P_{210b}$ of the rail member first surface 210*b*. Correspondingly, a second guide track 222 of the joining arrangement 220 is provided with a retaining surface 222*f* configured to, when in engagement with the rail member 210, have a normal $N_{222f}$ extending away from the plane $P_{210b}$ of the rail member first surface 210*b*. In other words, when in engagement, the retaining surfaces 221*f*, 222*f* will face the guide track first surfaces 211*b*, 212*b*. Other feature of the guide tracks presented in conjunction with other embodiments of guide tracks, such as those provided on the rail member 110 are applicable also the present embodiment, e.g. the mirrored configuration etc.

Common for both embodiments of the extendable wall rail system 100, 200 is, as the skilled person will understand after digesting the teachings herein, that the engagement portions 121, 122, 221, 222 and the retaining arrangement portions 111, 112, 2111, 212 are engaging with as little play as possible in order to ensure the rotationally rigid joint. This means, in the first embodiment of FIGS. 1 to 3, the joining member 120 will fit snuggly in the guide tracks 111, 112 of the rail members 110. In order to facilitate a tight fit and simplify insertion of the planar engagement portions of the engagement portions 121, 122 or the retaining arrangement portions 211, 212 into the guide tracks of the of the engagement portions 111, 112 or the retaining arrangement portions 221, 222, the planar engagement portions 121, 122, 211, 212 may be provided with a chamfer or bevel. Or, in other words, the rail member 210 or joining member 120 engaging the guide track 111, 112, 221, 222 may be provided with a beveled or chamfered corner for insertion into the guide track 111, 112, 221, 222. This is visualized in FIG. 3 where the planar engagement portions 121, 122 of the joining arrangement 120 are beveled.

Staying briefly to the joining member 120 of FIG. 3, one optional feature usable with the retaining arrangement portions 111, 211 and/or the engagement portions 121, 221 will be detailed. The joining member 120 of FIG. 3 is shown comprising an optional stop element 127. The stop element 127 is configured to ensure that the joining member 120 is not inserted too far into the mating rail member 110. This is accomplish by, in this embodiment, the stop element 127 comprising a first heel 127*a* and a second heel 127*b* projecting transversally, in the plane $P_{110b}$ of the rail member first surface 110*b*, to an insertion direction of the joining element 120. The first heel 127*a* and the second 127*b* are separated along the longitudinal extension of the joining element 120, and in order to allow short edges of the rail members 110 to meet when joined, the longitudinal edge 110*u*, 110*d* of the rail member engaging the stop element, may be shortened to compensate for the longitudinal separation of the heels 127*a*, 127*b* of the stop element 127. Preferably, the stop element 127 and the rail member 110 are configured such that the stop element 127 will be arranged vertically downwards when the rail member is mounted to the wall 10. This is beneficial as the cutout or shortened section of the longitudinal edge 110*u*, 110*d* will not significantly influence the rotational rigidity of the joint between the rail members 110 when extended with the joining element 120.

The stop element 127 as illustrated in FIG. 3 is one preferred embodiment. There are many other suitable stop members possible, such as arranging a stop at, i.e. in, the guide track 111, 112, 221, 222 even if it is provided on the joining member 120. Further to this, the corresponding stop element 127 may be provided on the rail members 110 when the retaining arrangement portions 211, 212 are engagement portion 211, 212.

As seen in both embodiments of the extendable wall rail system 100, 200, the rail member 110, 210 may be provided with one or more through holes 115, 215. These through holes 115, 215 will simplify attachment of the rail member 110, 210 to the wall 10. By arranging a plurality of through holes 115, 215 along the longitudinal extension of the rail member 110, 210, the likelihood of one through hole 115, 215 coinciding with a beam of the wall 10 is increased. The diameter of the through holes 115, 215 is preferably adapted to suit a fastening means 40 (see FIG. 7*c*), e.g. screw, nail etc., used to attach the rail member 110, 210 to the wall 10.

In some embodiments of the extendable wall rail system 100, 200, not necessarily part of the embodiments with the through holes 115, 215, the rail member 110, 210 may be provided with one or more enlarged through holes 115', 215. The enlarged through holes 115', 125' are enlarged in the sense that they are configured with a diameter that is larger than what would be considered suitable for the fastening means 40. Simply put, the enlarged through holes 115', 215' are provided with a diameter that is larger than a diameter of the through holes 115, 215. These enlarged through holes 115', 215' significantly simplify attachment of the rail member 110, 210 to walls 10 requiring pre-drilling. Pre-drilling in e.g. concrete, stone and other comparably hard materials, or materials having reinforcing bars such as rebar may be challenging, especially if horizontal and vertical alignment of the drilled hole is important. When attaching the rail members 110, 210 to the wall, it is generally required that the rail members 110, 210 are horizontally aligned and preferably correctly positioned vertically.

Figure 7A:
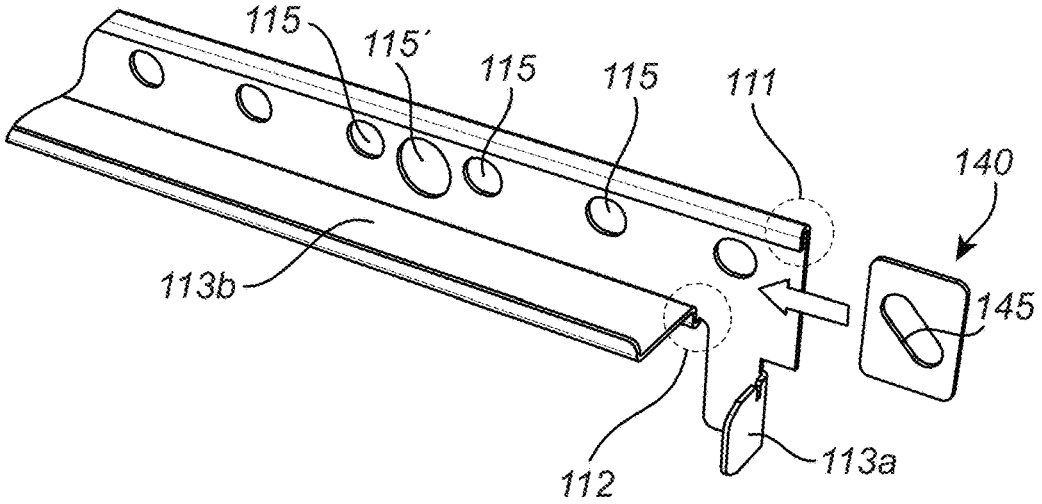
FIGS. 7*a* to 7*c* are partial perspective views of a rail member according to embodiments of the present disclosure.
Figure 7B:
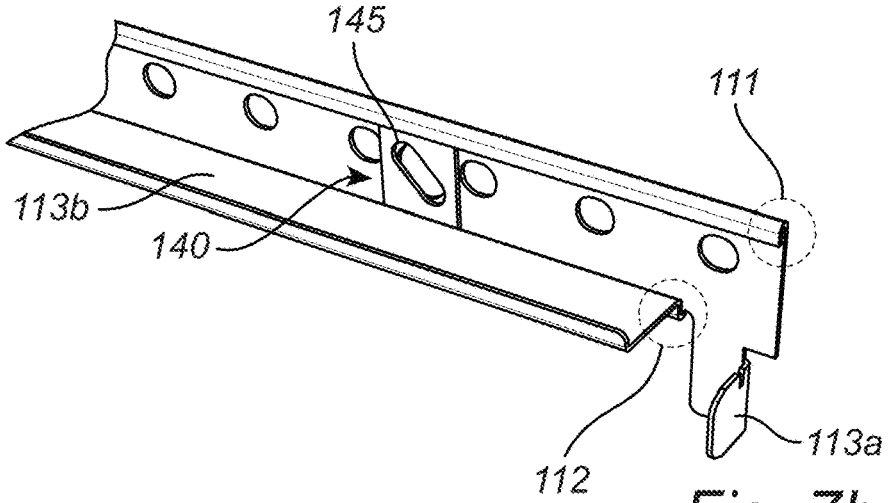
Figure 7C:
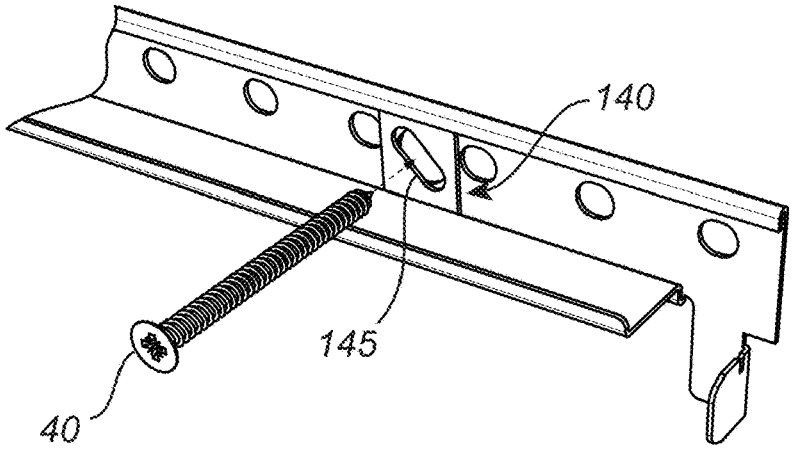

The problem with the alignment of the drilled hole with the though holes 115 of the rail members 110, 210 may be mitigated by combining the enlarged through hole 115', 215' with a washer 140 as illustrated in FIGS. 7*a-c*. In FIGS. 7*a-c*, the washer 140 is adapted for use with an extendable wall rail system 100 according to the first embodiment. However, although not shown, the skilled person will understand, after reading the present disclosure, how to configure a washer for use with the extendable wall rail system 200 of the second embodiment. The washer 140 is configured to engage the first retaining arrangement portion 111, 211 and the second retaining arrangement portion 112, 212 of the rail members 110, 210. That is to say, the washer 140 is configured to engage the retaining arrangement portions 111, 112, 211, 212 similarly to the engagement provided by the engagement portions 121, 122, 221, 222 of the corresponding joining arrangement 120, 220. However, the washer 140 does not snuggly and tightly engage the rail member 110, 210. The washer 140 is preferably configured to be movable along the rail members 110, 210, i.e. by, compared to the joining arrangement 120, 220, loosely engaging the first retaining arrangement portion 111, 211 and the second retaining arrangement portion 112, 212 of the rail members 110, 210. The washer 140 is provided with a longitudinal through hole 145, that is to say, the hole is not circular in shape but has an elongated shape. A breadth, i.e. the width of the longitudinal though hole 145 in a direction transverse to the longitudinal extension of the longitudinal through hole 145 is preferably substantially equal to the diameter of the through holes 115 of the rail members 110, 120. That is to say, the width of the longitudinal through hole 145 is configured for the fastening means 40. The longitudinal extension of the longitudinal though hole 145 of the washer 140 is configured such that it is arranged at an angle to the longitudinal extension of the rail members 110, 210. In a preferred further embodiment, its longitudinal extension is arranged at an angle of 45° to the longitudinal extension of the rail members 110, 120.

In FIG. 7*a*, the washer 140 is shown being inserted in the guide tracks 111, 112 of a rail member 110 according to the first embodiment. The washer 140 is movable along the rail members 110, 210, and in FIG. 7*b* it is illustrated as having its longitudinal through hole 145 aligned with the enlarged through hole 115' of the rail member 110. Due to the elongated shape of the longitudinal through hole 145 of the washer 140, and the increased diameter of the enlarged through hole 115' of the rail member 110, the accuracy required for aligning a drilled hole in the wall 10 with the through holes of the rail member 110 is decreased.

Figure 8:
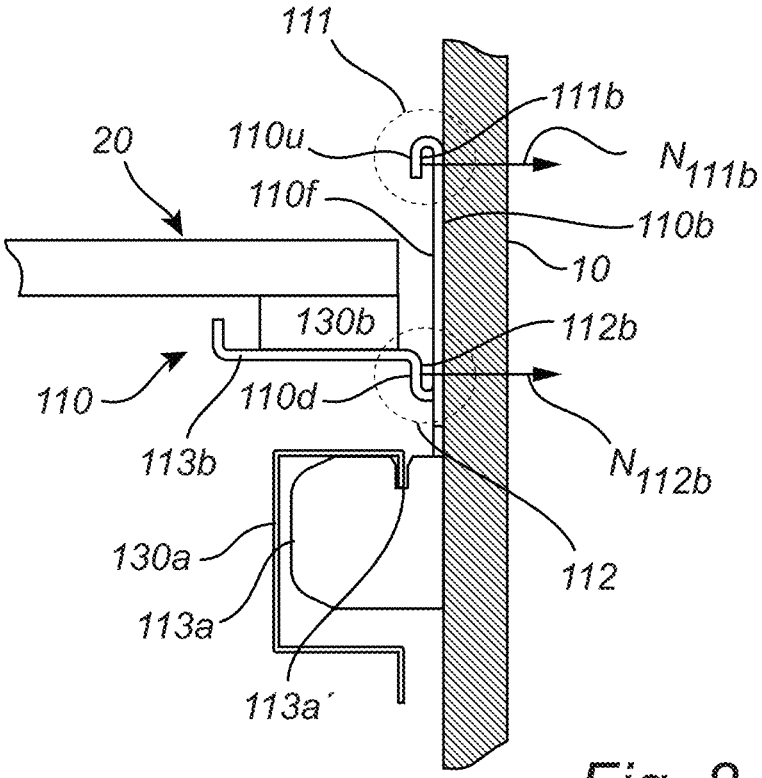
FIG. 8 is a side view of a rail member according to embodiments of the present disclosure.

In FIG. 8, a cross-sectional view of the extended wall rail system 100 according to one embodiment is shown. Although the following features are explained with reference to a wall rail system 100 according to the first embodiment, they are equally usable also with a wall rail system 200 according to the second embodiment. The extendable wall rail system 100 is show with a piece of furniture 20 attached to the wall rail system 100. A furniture bracket 130*a*, 130*b* is attached to the piece of furniture 20 and configured to engage the extendable wall rail system 100, 200. In FIG. 8, two embodiments of a furniture bracket 130*a*, 130*b* are shown. The furniture brackets 130*a*, 130*b* are configured to engage one of a first mounting bracket 113*a* and a second mounting bracket 113*b* of the rail member 110. Both mounting brackets 113*a*, 113*b* are extending substantially transversally from the plane $P_{210b}$ of the rail member first surface 110*b* in a direction away from the wall 10 when the rail member 110 is attached to the wall 10, i.e. from the a second surface 110*f* of the rail member 110, 210 being opposite the first surface 110*b*. The first mounting bracket 113*a* is a planar flange member 113*a* and extends in a plane substantially transverse to the longitudinal direction of the rail member 110. The second mounting bracket 113*b* is a planar support member 113*b* and extends in a plane along the longitudinal direction of the rail member 110. The first mounting bracket 113*a* is provide with a retaining portion 113*a*' in the form of a cutout at an edge of the first mounting bracket facing vertically upwards when the rail member 110 is mounted to the wall 10. A first furniture bracket 130*a* is configured to engage the first mounting bracket 113*a* and interface the retaining portion 113*a*' of the first mounting bracket 113*a* such that gravity will effectively retain the first bracket in engagement with the first mounting bracket 113*a* and thereby the extendable wall rail system 100. Similarly, the second mounting bracket 113*b* is provide with a ridge portion 113*b*' that extends, when the rail member 110 is attached to the wall 10, vertically upwards at a longitudinal end of the planar support member 113*b* distal from the rail member first surface 110*b*. A second furniture bracket 130*b* is configured to engage the second mounting bracket 113*b* such that it rests on an, when the rail member 110 is attached to the wall 10, vertically upper surface of the second mounting bracket 113*b*. The second furniture bracket 130*b*, when engaging the extendable wall rail system 100, is arranged between the ridge portion 113*b*' of the second mounting bracket and a surface of the rail member 110 that is opposite to the rail member first surface 110*b*.

The presented furniture brackets 130*a*, 130*b* and mating mounting brackets 113*a*, 113*b* are, as mentioned, optional. Even if included, both versions are not required and only one may be selected depending on suitability. Further to this, the exemplified furniture brackets 130*a*, 130*b* and mating mounting brackets 113*a*, 113*b* are but two examples, and the skilled person will, after reading this disclosure, be prepared to adapt, alter and adjust the furniture brackets 130*a*, 130*b* and mating mounting brackets 113*a*, 113*b* to form different means of attaching the furniture 20 to the wall rail system 100, 200.

The furniture brackets 130*a*, 130*b* are preferably configured for attachment to, when the piece of furniture 20 is mounted to the wall 10, vertical sides of the wall mounted piece of furniture 20. This reduced a load that a top portion of the wall mounted piece of furniture 20 have to carry if the furniture brackets 130*a*, 130*b* are mounted to the top portion of the wall mounted piece of furniture 20.

Figure 9A:
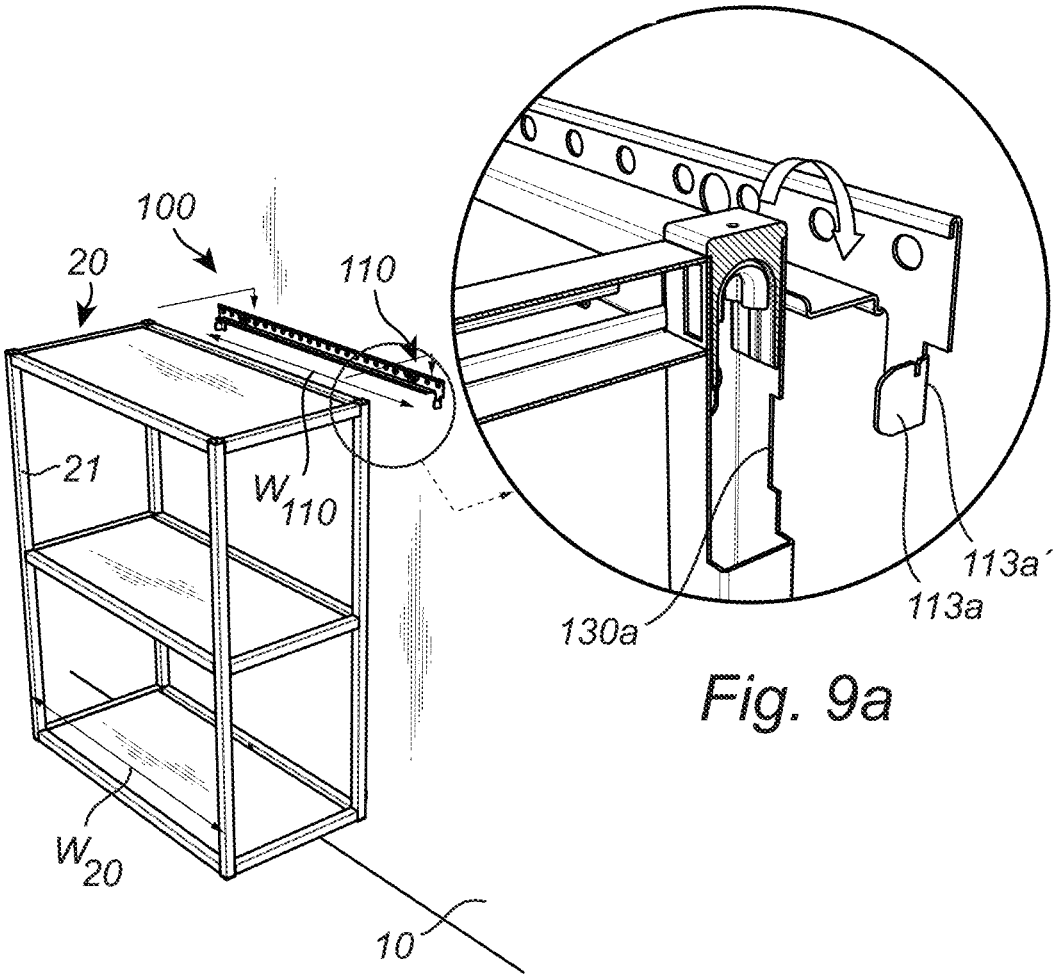
FIGS. 9*a* to 9*c* are perspective views of a wall mounted piece of furniture being attached to an extendable wall rail system according to embodiments of the present disclosure.
Figure 9B:
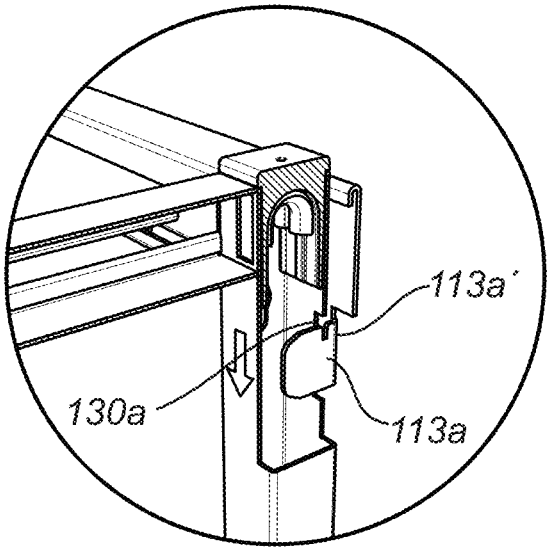
Figure 9C:
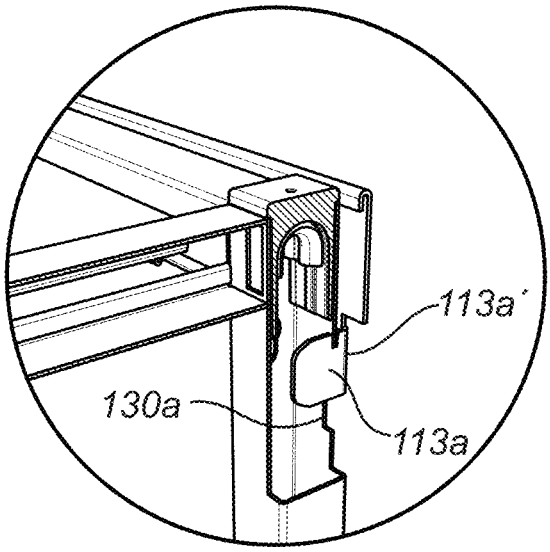

In FIGS. 9*a-c*, one embodiment of a wall mounted piece of furniture 20 is shown. The piece of furniture 20 is configured to be attached to an extendable wall rail system 100, 200 of the present disclosure. The piece of furniture 20 is attached to the extendable wall rail system 100, 200 at an upper side and may comprise one or more legs (not shown) configured to support the piece of furniture on a floor. The legs may be provided as an additional support feature in conjunction with the furniture brackets for attachment to the extendable wall rail system 100, 200. Preferably, legs are provided at a front side of the piece of furniture, i.e. a side distal to the wall 10. The piece of furniture 20, in this embodiment, is provided with a first furniture bracket 130*a* formed as an opening 130*a* in a frame 21 of the piece of furniture 20. The frame 21 may be a hollow frame, preferably a hollow metal frame, or a frame 21 of any other suitable shape of form wherein the opening 130*a* is configured such that is engages the retaining portion 113*a*' of the first mounting bracket 113*a*. In the present embodiment, this engagement is provided by lifting the frame 21, see FIG. 9*a*, to align the openings 130*a* with the first brackets 113*a* and arranging the frame 21 such that the first brackets 113*a* enter the openings. By pushing the frame vertically downwards, FIG. 9*b*, the frame 21 will engage the retaining portion 113' of the first mounting bracket 113*a* and the piece of furniture 20 will be removably attached to the extendable wall rail system 100, 200, see FIG. 9*c*.

It should be noted that the wall mounted piece of furniture 20 may be provided with any number of openings 130*a*, and the rail member 110, 210 may be provided with any number of mounting brackets 113*a*, 113*b*. In a preferred embodiment, the rail member 110, 210 comprises two first mounting brackets 113*a*, one at each longitudinal end of the rail member 110, 210 (or slightly offset to allow room for the stop element 127 as previously presented). A longitudinal width $w_{110}$ of the rail member is preferably equal to, or shorter, that a corresponding width $w_{20}$ of the wall mounted piece of furniture 20. This is beneficial as each wall mounted piece of furniture 20 may be delivered with one rail member 110, 210 and the wall mounted piece of furniture 20 may be mounted to the wall 10 via the rail member 10 without having to cut the rail member to size. Further to this, the wall mounted piece of furniture 20 may be mounted without the rail member 110, 210 being visible. Several of these pieces of wall mounted piece of furniture 20 may be mounted next to each other by extending the rail members 110, 210 by joining members 120, 220. The wall mounted piece of furniture 20 may each have different widths $w_{20}$, and be provided with rail members 120, 220 having respective widths $w_{110}$ being shorter or equal to the widths $w_{20}$ of the rail members 110, 210.

Figure 10:
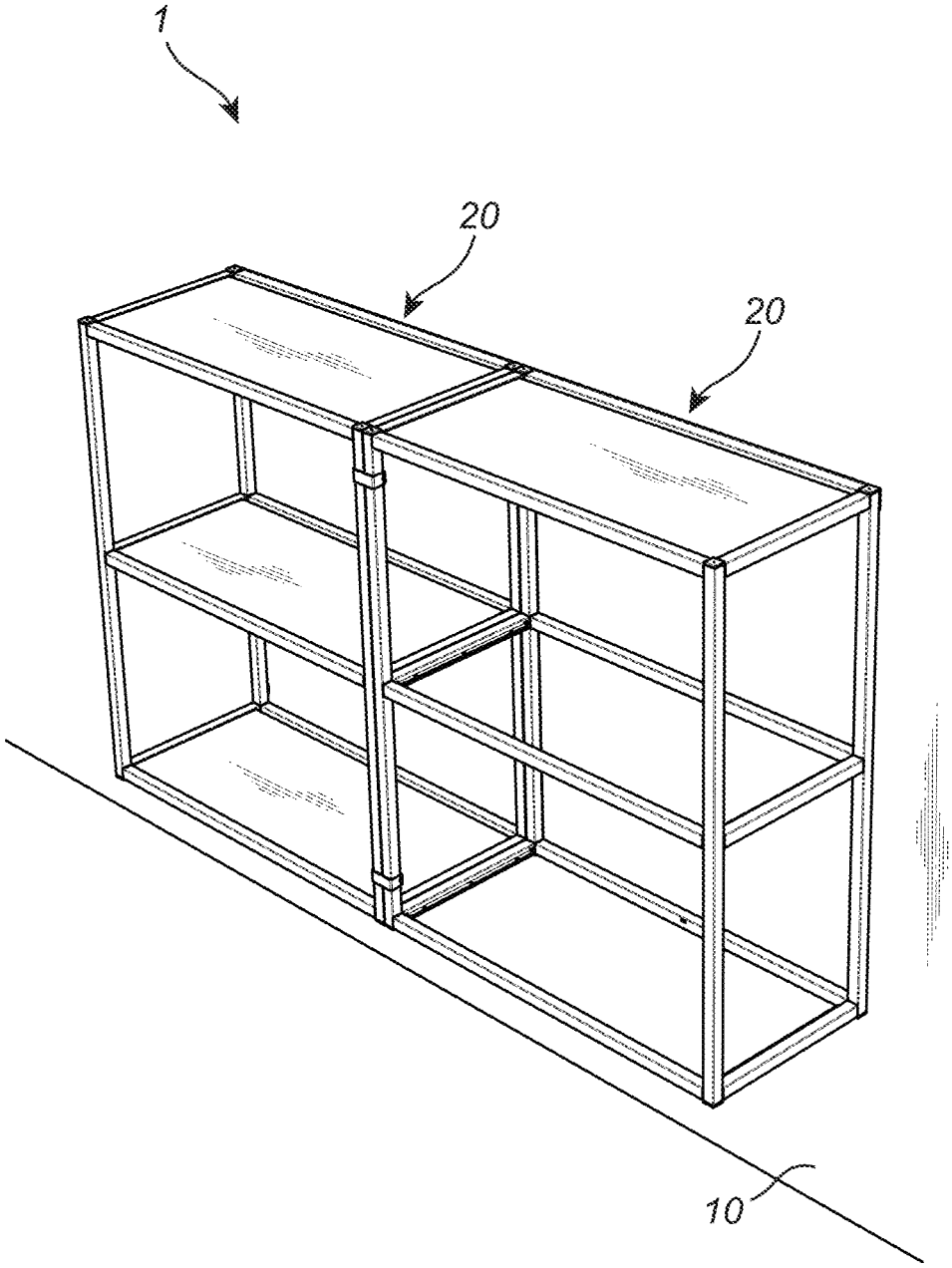
FIG. 10 is a perspective view of a furniture system according to embodiments of the present disclosure.

In FIG. 10, a furniture system 1 comprising a plurality of wall mounted pieces of furniture 20 is shown. The wall mounted pieces of furniture 20 are attached to a wall 10 by one single extendable wall rail system 100, 200 according to the present disclosure.

Modifications and other variants of the described embodiments will come to mind to one skilled in the art having benefit of the teachings presented in the foregoing description and associated drawings. Therefore, it is to be understood that the embodiments are not limited to the specific example embodiments described in this disclosure and that modifications and other variants are intended to be included within the scope of this disclosure. For example, while embodiments of the invention have been described with reference wall mounted pieced of furniture, persons skilled in the art will appreciate that the embodiments of the invention can equivalently be applied to other items being mounted to a wall, or requiring a rotationally rigid joint when being extended. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. Furthermore, although individual features may be included in different claims (or embodiments), these may possibly advantageously be combined, and the inclusion of different claims (or embodiments) does not imply that a combination of features is not feasible and/or advantageous. In addition, singular references do not exclude a plurality. Finally, reference signs in the claims are provided merely as a clarifying example and should not be construed as limiting the scope of the claims in any way.

The invention claimed is:

1. An extendable wall rail system, comprising:

a first rail member and a second rail member, each having a rail member first surface configured for attachment to a wall, a first retaining arrangement portion, and a second retaining arrangement portion;

a joining member including a plurality of first engagement portions and a plurality of second engagement portions, the joining member configured to releasably join the first rail member to the second rail member via matingly engaging i) the first retaining arrangement portion of the first rail member and the first retaining arrangement portion of the second rail member with the plurality of first engagement portions and ii) the second retaining arrangement portion of the first rail member and the second retaining arrangement portion of the second rail member with the plurality of second engagement portions, to form a rotationally rigid joint between the first rail member and the second rail member; and wherein the first rail member and/or the second rail member includes a mounting bracket configured to attach a piece of furniture to the associated rail member, the mounting bracket including a planar member projecting from the associated rail member in a direction away from the rail member first surface.

2. The extendable wall rail system of claim 1, wherein the first retaining arrangement portion and/or the second retaining arrangement portion is a guide track with a retaining surface having a normal extending towards a plane of the rail member first surface and a corresponding engagement portion of the joining member is arrangeable between the retaining surface and the plane of the rail member first surface to matingly engage the guide track.

3. The extendable wall rail system of claim 1, wherein:

a first engagement portion of the plurality of first engagement portions and/or a second engagement portion of the plurality of second engagement portions includes a guide track defining a channel, the guide track having a retaining surface configured to, when in engagement with the first rail member and/or the second rail member, have a normal extending away from a plane of the rail member first surface; and the first retaining arrangement portion and/or the second retaining arrangement portion is a corresponding engagement portion configured to matingly engage the channel of the guide track such that the retaining surface is arranged between the corresponding engagement portion and the plane of the rail member first surface.

4. The extendable wall rail system of claim 1, further comprising a furniture bracket for attachment to a piece of furniture, wherein the furniture bracket is configured to releasably engage the first rail member and/or the second rail member.

5. The extendable wall rail system of claim 1, wherein the first rail member and/or the second rail member includes a plurality of through holes arranged spaced along a longitudinal extension of the corresponding rail member for attachment of the corresponding rail member to the wall.

6. The extendable wall rail system of claim 5, further comprising a washer, wherein:

the first rail member and/or the second rail member further includes an enlarged through hole having a diameter that is greater than a diameter of the plurality of through holes;

the washer is movable along the first retaining arrangement portion and the second retaining arrangement portion of the first rail member and/or the second rail member; and the washer includes a longitudinal through hole having, when engaging at least one retaining arrangement portion, a longitudinal extension arranged at an angle relative to a longitudinal extension of the first rail member and/or the second rail member.

7. The extendable wall rail system of claim 5, wherein the joining member includes a plurality of through holes configured to coincide with a plurality of corresponding through holes of the plurality of through holes of the first rail member and the plurality of through holes of the second rail member when the joining member is arranged to extend the first rail member with the second rail member.

8. The extendable wall rail system of claim 1, wherein the joining member includes a stop element configured to control a maximum distance the joining member is inserted into each of the first rail member and the second rail member.

9. A furniture bracket for attachment to a piece of furniture, wherein the furniture bracket is configured to releasably engage the extended wall rail system according to claim 1.

10. A wall mounted piece of furniture, comprising:

a first rail member configured to form part of the extendable wall rail system according to claim 1;

a furniture bracket for attachment to the piece of furniture, the furniture bracket configured to releasably engage the first rail member; and wherein the piece of furniture has a width equal to or longer than a longitudinal extension of the first rail member.

11. A furniture system, comprising a plurality of wall mounted pieces of furniture according to claim 10 and a joining member configured to form part of the extendable wall rail system.

12. The extendable wall rail system of claim 1, wherein:

the mounting bracket is arranged at a first longitudinal edge of the first rail member; and the first rail member further includes a second mounting bracket arranged at an opposite second longitudinal edge of the first rail member.

13. The extendable wall rail system of claim 6, wherein the longitudinal extension of the through hole of the washer is arranged at an angle of 45° relative to the longitudinal extension of the first rail member and/or the second rail member.

14. The extendable wall rail system of claim 1, wherein the planar member of the mounting bracket is arranged on and extends from the second retaining arrangement portion.

15. The extendable wall rail system of claim 14, wherein the planar member of the mounting bracket is a planar support member oriented transversely to the rail member first surface and extending along the second retaining arrangement portion in a longitudinal direction of the associated rail member.

16. The extendable wall rail system of claim 15, wherein the mounting bracket further includes a ridge portion projecting from an end of the planar support member opposite the second retaining arrangement portion.

17. The extendable wall rail system of claim 1, wherein the planar member of the mounting bracket is a planar flange member oriented transversely to the rail member first surface and to a longitudinal direction of the associated rail member.

18. The extendable wall rail system of claim 17, wherein the planar flange member includes a cutout configured to receive and releasably engage a furniture bracket.

19. An extendable wall rail system, comprising:

a first rail member and a second rail member, each having a rail member first surface configured for attachment to a wall, a first retaining arrangement portion, and a second retaining arrangement portion;

a joining member including a plurality of first engagement portions and a plurality of second engagement portions, the joining member configured to releasably join the first rail member to the second rail member via matingly engaging i) the first retaining arrangement portion of the first rail member and the first retaining arrangement portion of the second rail member with the plurality of first engagement portions and ii) the second retaining arrangement portion of the first rail member and the second retaining arrangement portion of the second rail member with the plurality of second engagement portions, to form a rotationally rigid joint between the first rail member and the second rail member; and a washer;

wherein the first rail member and/or the second rail member includes a plurality of through holes arranged spaced along a longitudinal extension of the corresponding rail member for attachment of the corresponding rail member to the wall;

wherein the first rail member and/or the second rail member further includes an enlarged through hole having a diameter that is greater than a diameter of the plurality of through holes;

wherein the washer is movable along the first retaining arrangement portion and the second retaining arrangement portion of the first rail member and/or the second rail member; and wherein the washer includes a longitudinal through hole having, when engaging at least one retaining arrangement portion, a longitudinal extension arranged at an angle relative to a longitudinal extension of the first rail member and/or the second rail member.

20. An extendable wall rail system, comprising:

a first rail member and a second rail member, each having a rail member first surface configured for attachment to a wall, a first retaining arrangement portion, and a second retaining arrangement portion; and a joining member including a plurality of first engagement portions and a plurality of second engagement portions, the joining member configured to releasably join the first rail member to the second rail member via matingly engaging i) the first retaining arrangement portion of the first rail member and the first retaining arrangement portion of the second rail member with the plurality of first engagement portions and ii) the second retaining arrangement portion of the first rail member and the second retaining arrangement portion of the second rail member with the plurality of second engagement portions, to form a rotationally rigid joint between the first rail member and the second rail member;

wherein the first rail member and/or the second rail member includes a plurality of through holes arranged spaced along a longitudinal extension of the corresponding rail member for attachment of the corresponding rail member to the wall; and wherein the joining member includes a plurality of through holes configured to coincide with a plurality of corresponding through holes of the plurality of through holes of the first rail member and the plurality of through holes of the second rail member when the joining member is arranged to extend the first rail member with the second rail member.

* * * * *